US006845757B2

(12) United States Patent
Strahberger et al.

(10) Patent No.: US 6,845,757 B2
(45) Date of Patent: Jan. 25, 2005

(54) FUEL INJECTION SYSTEM FOR AN INTERNAL COMBUSTION ENGINE

(75) Inventors: Herbert Strahberger, Gallneukirchen (AT); Serge Moling, Arnas (FR); Peter Voigt, Regensburg (DE); Alain Amblard, Genas (FR)

(73) Assignee: Robert Bosch GmbH, Stuttgart (DE)

( * ) Notice: Subject to any disclaimer, the term of this patent is extended or adjusted under 35 U.S.C. 154(b) by 70 days.

(21) Appl. No.: 10/362,014

(22) PCT Filed: May 18, 2002

(86) PCT No.: PCT/DE02/01799

§ 371 (c)(1),
(2), (4) Date: Jul. 18, 2003

(87) PCT Pub. No.: WO02/103197

PCT Pub. Date: Dec. 27, 2002

(65) Prior Publication Data

US 2004/0099250 A1 May 27, 2004

(30) Foreign Application Priority Data

Jun. 19, 2001 (DE) ..... 201 10 130 U

(51) Int. Cl.[7] ..... F02M 57/02; F02M 61/20; F02M 45/08; F02M 59/36

(52) U.S. Cl. ..... 123/467; 123/506; 123/496; 239/88; 239/96

(58) Field of Search ..... 123/467, 446, 123/447, 506, 496; 239/88–96, 533.1–533.12

(56) References Cited

U.S. PATENT DOCUMENTS

| | | | | | |
|---|---|---|---|---|---|
| 4,566,416 | A | * | 1/1986 | Berchtold | 123/458 |
| 4,572,433 | A | * | 2/1986 | Deckard | 239/88 |
| 5,012,786 | A | * | 5/1991 | Voss | 123/467 |
| 5,125,581 | A | * | 6/1992 | Kronberger | 239/533.5 |
| 5,328,094 | A | * | 7/1994 | Goetzke et al. | 239/88 |
| 5,832,899 | A | * | 11/1998 | Soteriou | 123/456 |
| 6,283,390 | B1 | * | 9/2001 | Brendle et al. | 239/533.2 |
| 6,305,359 | B1 | * | 10/2001 | Kronberger et al. | 123/506 |

FOREIGN PATENT DOCUMENTS

| | | |
|---|---|---|
| DE | 39 00 763 A | 7/1990 |
| EP | 0 767 304 A | 4/1997 |

* cited by examiner

*Primary Examiner*—Weilun Lo
(74) *Attorney, Agent, or Firm*—Ronald E. Greigg

(57) ABSTRACT

The fuel injection system has one high-pressure fuel pump and one fuel injection valve for one cylinder of the engine. The fuel pump has a work chamber, and the injection valve has a valve member, and which is movable in an opening direction, counter to the force of a closing spring, by the pressure in a pressure chamber communicating with the pump work chamber; the closing spring is braced between the injection valve member and a displaceable deflection piston which, defines a prechamber that communicates with the pump work chamber. The deflection piston is movable into a storage chamber counter to the force of the closing spring. The prechamber communicates with the pump work chamber via a first throttle restriction, and the pressure chamber of the fuel injection valve communicates with the pump work chamber via a second throttle restriction, circumventing the prechamber.

6 Claims, 1 Drawing Sheet

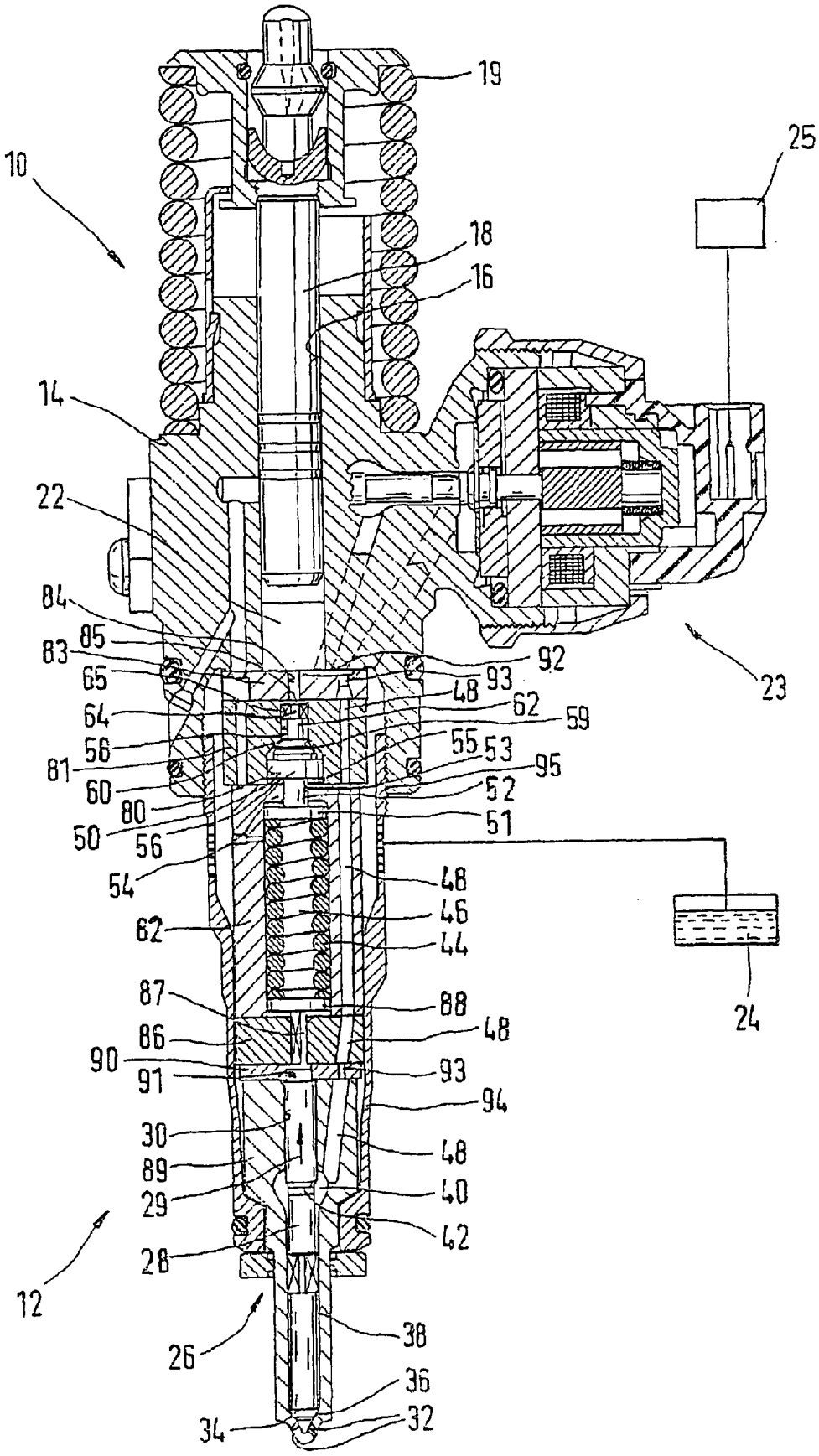
19
25
10
18
16
14
22
84
85
83
65
92
93
48
62
64
59
56
55
53
81
95
60
52
80
51
50
56
54
48
46
62
44
87
88
24
86
48
90
93
91
94
30
48
89
40
29
42
28
12
38
26
36
34
32
23

FUEL INJECTION SYSTEM FOR AN INTERNAL COMBUSTION ENGINE

CROSS-REFERENCE TO RELATED APPLICATIONS

This application is a 35 USC 371 application of PCT/DE 02/01799 filed on May 18, 2002.

BACKGROUND OF THE INVENTION

1. Field of the Invention

The invention is directed to an improved fuel injection system for an internal combustion engine.

2. Description of the Prior Art

One fuel injection system of the type with which this invention is concerned, known from German Patent Disclosure DE 39 00 763 A1, has a high-pressure fuel pump and a fuel injection valve for each cylinder of the engine. The high-pressure fuel pump has an engine-driven pump piston defining a pump work chamber, and a communication of the pump work chamber with a relief chamber is controlled by an electrically controlled valve. The fuel injection valve has an injection valve member, by which at least one injection opening is controlled, and which is movable in an opening direction, counter to the force of a closing spring disposed in a spring chamber, by the pressure prevailing in a pressure chamber that communicates with the pump work chamber. The closing spring is braced on one end at least indirectly on the injection valve member and on the other at least indirectly on a deflection piston. The deflection piston, on its side remote from the closing spring, defines a prechamber communicating with the pump work chamber via a throttle restriction and is thus subjected to the pressure prevailing in the pump work chamber and is movable in a reciprocating motion counter to the force of the closing spring. The deflection piston is movable from an outset position, at low pressure in the pressure chamber, into a storage chamber. The pressure chamber of the fuel injection valve communicates via a conduit with the prechamber and via this chamber communicates indirectly with the pump work chamber. The communication of the pressure chamber with the pump work chamber is thus likewise effected via the throttle restriction; the dimensioning of the throttle restriction must be selected as a compromise between the dimensioning required for the function of the deflection piston and the dimensioning required for the function of the fuel injection valve.

SUMMARY OF THE INVENTION

The fuel injection system of the invention has the advantage over the prior art that by means of the direct communication of the pressure chamber of the fuel injection valve with the pump work chamber via the at least one second throttle restriction, the first and the at least one second throttle restriction can be selected optimally for the respective function, independently of one another.

Advantageous features and refinements of the fuel injection system of the invention are disclosed. One embodiments makes simple arrangements and embodiments of the throttle restrictions possible from a standpoint of production technology.

BRIEF DESCRIPTION OF THE DRAWINGS

One exemplary embodiment of the invention is explained in further detail herein below, with to the single drawing figure which is a longitudinal section of a fuel injection system embodying the invention for use in an internal combustion engine.

DESCRIPTION OF THE PREFERRED EMBODIMENT

In the drawing, a fuel injection system embodying the invention for use in an internal combustion engine of a motor vehicle is shown. The engine has one or more cylinders, and for each cylinder there is one fuel injection system, with a high-pressure fuel pump 10 and a fuel injection valve 12. The high-pressure fuel pump 10 and the fuel injection valve 12 are combined into a so-called unit fuel injector. The high-pressure fuel pump 10 has a pump body 14, in which a pump piston 18 is guided tightly in a cylinder bore 16; the pump piston is driven in a stroke motion by a cam of a camshaft of the engine, counter to the force of a restoring spring 19. In the cylinder bore 16, the pump piston 18 defines a pump work chamber 22, in which fuel is compressed at high pressure in the pumping stroke of the pump piston 18. In the intake stroke of the pump piston 18, fuel from a fuel tank 24 is delivered to the pump work chamber, for instance by means of a feed pump. The pump work chamber 22 has a communication with a relief chamber, such as the fuel tank 24, and which is controlled by an electrically controlled valve 23. The electrically controlled valve 23 is connected to a control unit 25.

The fuel injection valve 12 has a valve body 26, which as will be explained in greater detail below is embodied in multiple parts and is connected to the pump body 14. In the valve body 26, an injection valve member 28 is guided longitudinally displaceably in a bore 30. The bore 30 extends at least approximately parallel to the cylinder 16 of the pump body 14 but can also extend at an incline to it. The valve body 26, in its end region toward the combustion chamber of the cylinder of the engine, has at least one and preferably more injection openings 32. The injection valve member 28, in its end region toward the combustion chamber, has a sealing face 34, which for instance is approximately conical, and which cooperates with a valve seat 36, for instance also approximately conically, embodied in the valve body 26, in its end region toward the combustion chamber, and from the valve seat or downstream of it, the injection openings 32 lead away.

In the valve body 26, between the injection valve member 28 and the bore 30, toward the valve seat 36, there is an annular chamber 38, which in its end region remote from the valve seat 36 changes over, by means of a radial enlargement of the bore 30, into a pressure chamber 40 surrounding the injection valve member 28. At the level of the pressure chamber 40, as a result of a cross-sectional reduction, the injection valve member 28 has a pressure shoulder 42 pointing toward the valve seat 36. The end of the injection valve member 28 remote from the combustion chamber is engaged by a prestressed closing spring 44, by which the injection valve member 28 is pressed toward the valve seat 36. The closing spring 44 is disposed in a spring chamber 46, which adjoins the bore 30. The spring chamber 46 preferably communicates with a relief chamber, such as the fuel tank 24. The pressure chamber 40 communicates with the pump work chamber 22 via a conduit 48 extending through the valve body 26.

The closing spring 44 is braced on one end, at least indirectly, for instance via a spring plate, on the injection valve member 28 and on the other end, at least indirectly, for instance also via a spring plate 51, on a deflection piston 50. The deflection piston 50 is guided in a bore 80 of a housing part 81 and, in its end region toward the closing spring 44, has a shaft part 52, which passes through a connecting bore 53 in a partition 54 of the housing part 81 between the spring chamber 46 and a storage chamber 55 adjoining the spring chamber in the housing part 81. The spring plate 51 is braced on the end of the shaft part 52 that protrudes into the spring chamber 46. The connecting bore 53 has a smaller diameter than the spring chamber 46 and the storage chamber 55. In the storage chamber 55, the deflection piston 50 has one region 56 with a larger diameter than the connecting bore 53, so that a stroke motion of the deflection piston 50 into the spring chamber 46 is limited by the fact that the region 56 of the deflection piston 50 comes to rest against the partition 54, as a stop. The deflection storage piston 50 is guided with its region 56 tightly in the bore 80, whose diameter is correspondingly larger than the connecting bore 53. The spring chamber 46 is embodied as a bore in a housing part 82, which forms one part of the valve body 26. The conduit 48 extends through the housing part 82 offset from and approximately parallel to the spring chamber 46.

From the storage chamber 55, from its end remote from the spring chamber 46, a bore 58 leads to the pump work chamber 22 in the housing part 81. The bore 58 has a smaller diameter than the bore 80. Toward the bore 58, adjoining the region 56, the deflection piston 50 has a sealing face 60, which is for instance embodied approximately conically. The sealing face 60 cooperates with the orifice of the bore 58 into the storage chamber 55 at the housing part 81 as a seat, which can likewise be approximately conical. The deflection piston 50 has a shaft 62, which protrudes into the bore 58 and whose diameter is less than that of the region 56. Adjoining the sealing face 60, the shaft 62 initially has a substantially smaller diameter than the bore 58, and adjoining that, toward its free end, it has a shaft region 64 with a diameter that is only slightly smaller than the diameter of the bore 58. The shaft region 64 can have one or more flat faces 65 on its circumference, by which openings between the shaft region 64 and the bore 58 are formed, through which openings fuel can reach the storage chamber 55.

Between the housing part 81 and the pump body 14, there is a shim 83, in which a bore 84 is embodied, through which the bore 58 in the housing part 81 communicates with the pump work chamber 22. The bore 84 acts as a first throttle restriction, by way of which the bore 58 communicates with the pump work chamber 22. In the bore 58, toward the shim 83, the deflection piston 50 defines a prechamber 85, which communicates with the pump work chamber 22 via the first throttle restriction 84.

When the deflection piston 50 is in an outset position, in which it rests with its pressure face 60 on the sealing seat at the orifice of the bore 58, the storage chamber 55 is disconnected from the prechamber 85 and thus from the pump work chamber 22. In the outset position of the deflection piston 50, the pressure prevailing in the pump work chamber 22 acts on the end face of the shaft region 64 and, through the openings between the shaft region 64 and the bore 58, on the pressure face 60 of the storage piston 50, in accordance with the diameter of the bore 58. By the force of the closing spring 44, the deflection piston 50 is kept in its outset position counter to the pressure prevailing in the pump work chamber 22 and thus in the prechamber 85, if the force exerted on the deflection piston 50 by the pressure in the pump work chamber 22 is less than the force of the closing spring 44.

If the pressure in the pump work chamber 22 and thus in the prechamber 85 rises so much that the force generated on the deflection piston 50 is greater than the force of the closing spring 44, then the deflection piston 50 and with it the shaft part 52 moves in a deflection motion into the storage chamber 55, whereupon the shaft part 52 moves into the spring chamber 46. In the deflection motion of the deflection piston 50, fuel from the storage chamber 55 is positively displaced into the spring chamber 46, and this fuel must pass through an annular gap between the shaft part 52 of the deflection piston 50 and the connecting bore 53. As a result, damping of the deflection motion of the shaft part 52 and hence of the deflection piston 50 is achieved.

Toward the fuel injection valve 12, adjoining the housing part 82, there is a further housing part 86, as part of the valve body 26; it has a bore 87, through which an end region of the injection valve member 28 passes and protrudes into the spring chamber 46. The injection valve member 28, with its end region, is braced in the spring chamber 46 on the closing spring 44, via a spring plate 88. The end region of the injection valve member 28 has a smaller diameter than its region that is guided in the bore 30. The bore 30, the pressure chamber 40, and the annular chamber 38, on whose lower end the valve seat 34 and the injection openings 32 are disposed, are embodied in a valve housing 89 that forms part of the valve body 26. A shim 90 of slight thickness is disposed between the housing part 86 and the valve housing 89. The shim 90 has a bore 91, through which the end region of the injection valve member 28 passes.

The conduit 48 extends from the pressure chamber 40 through the valve housing 89, the shim 90, the housing part 86, the housing part 82, and the shim 83. The shim 83, on its side toward the pump body 14, has a groove 92, which is open toward the pump work chamber 22 and into which the conduit 48 discharges. The groove 92 can for instance extend approximately radially to the cylinder bore 16 and from the cylinder bore 16 extends outward as far as the region of the shim 83 in which the conduit 48 extends through this shim. Thus the communication of the pressure chamber 40 of the fuel injection valve 12 with the pump work chamber 22 through the conduit 48 is effected directly, circumventing the prechamber 85 that is defined by the deflection piston 50 in the bore 58 toward the shim 83. At least one second throttle restriction 93 is provided in the conduit 48 connecting the pressure chamber 40 with the pump work chamber 22. By means of the second throttle restriction 93, damping of pressure fluctuations in the conduit 48 can be attained. The second throttle restriction 93 can be formed by a purposeful reduction in the cross section of the conduit 48. In particular, it may be provided here that the conduit 48 in the shim 83 and/or in the shim 90 be embodied with a defined cross section, in order to form the throttle restriction 93 as a throttle bore. The first throttle restriction 84 and the second throttle restriction 93 can be selected optimally for the respective function, independently of one another.

The fuel injection valve 12 and the high-pressure fuel pump 10 are connected to one another by means of a clamping sleeve 94. The clamping sleeve 94 fits over the valve housing 89 and is screwed into a threaded bore 95 in the pump body 14. The shim 83, the housing parts 81, 82, and 86, and the shim 90 are fastened between the valve housing 89 and the pump body 14.

The function of the fuel injection system will now be explained. The pump work chamber 22 is filled with fuel during the intake stroke of the pump piston 18. In the pumping stroke of the pump piston 18, the control valve 23 is opened first, so that high pressure cannot build up in the pump work chamber 22. When the fuel injection is to begin, the control valve 23 is closed by the control unit 25, so that the pump work chamber 22 is disconnected from the fuel tank 24, and high pressure builds up in the work chamber. When the pressure in the pump work chamber 22 and in the pressure chamber 40 is so high that the force on the injection valve member 28 acting in the opening direction 29 via the pressure shoulder 42 is greater than the force of the closing spring 44, the injection valve member 28 moves in the opening direction 29 and uncovers the at least one injection opening 32, through which fuel is injected into the combustion chamber of the cylinder. The deflection piston 50 is in an outset position at this time. The pressure in the pump work chamber 22 subsequently increases further, in accordance with the profile of the cam that drives the pump piston 18.

The pressure in the pump work chamber 22 subsequently increases further, in accordance with the profile of the cam that drives the pump piston 18.

When the force exerted on the deflection piston 50 by the pressure prevailing in the pump work chamber 22 and thus in the prechamber 85 becomes greater than the force exerted by the closing spring 44 on the deflection piston 50, the deflection piston 50 executes its deflecting reciprocating motion and moves into the storage chamber 55. This causes a pressure drop in the pump work chamber 22 and also increases the prestressing of the closing spring 44 that is braced on the storage piston 50 via the shaft part 52. Because of the pressure drop in the pump work chamber 22 and in the pressure chamber 40, there is a lesser force in the opening direction 29 on the injection valve member 28, and because of the increase in the prestressing of the closing spring 44, the result is an increased force in the closing direction on the injection valve member 28, so that the injection valve member moves in the closing direction again, comes to rest with its pressure face 34 on the valve seat 36, and closes the injection openings 32, thus interrupting the fuel injection. The fuel injection valve 12 is opened for only a brief length of time, and only a slight quantity of fuel is injected into the combustion chamber as a preinjection. The injected fuel quantity is determined essentially by the opening pressure of the deflection piston 50, that is, the pressure in the pump work chamber 22 and in the prechamber 85 at which the deflection piston 50 begins its deflecting reciprocating motion. The opening stroke of the injection valve member 28 during the preinjection can be limited hydraulically by a damping device. A damping device of this kind is known from German Patent Disclosures DE 39 00 762 A1 and DE 39 00 763 A1 and U.S. Pat. Nos. 5,125,580 and 5,125,581, respectively, corresponding to them, which are hereby incorporated by reference. The reciprocating motion of the deflection piston 50 can also be damped by means of a damping device of the kind described in DE 39 00 762 A1, DE 39 00 763 A1, U.S. Pat. No. 5,125,580, and U.S. Pat. No. 5,125,581.

Afterward, the pressure in the pump work chamber 22 continues to rise in accordance with the profile of the cam that drives the pump piston 18, so that the pressure force acting on the injection valve member 28 in the opening direction 29 again increases and exceeds the increased deflection piston resulting from the increased prestressing of the closing spring 44, so that the fuel injection valve 12 opens again. Now a larger fuel quantity is injected over a longer period of time than during the preinjection. The duration and the fuel quantity injected during this main injection are determined by the instant at which the control valve 23 is opened again by the control unit 25. Once the control valve 23 has opened, the pump work chamber 22 again communicates with the fuel tank 24, so that it is relieved, and the fuel injection valve 12 closes. The deflection piston 50 with the shaft part 52 is moved back into its outset position by the force of the closing spring 44. The chronological offset between the preinjection and the main injection is determined primarily by the deflection stroke of the deflection piston 50.

The foregoing relates to preferred exemplary embodiments of the invention, it being understood that other variants and embodiments are possible within the spirit and scope of the invention, the latter being defined by the appended claims.

What is claimed is:

1. In a fuel injection system for an internal combustion engine, having one high-pressure fuel pump (10) and one fuel injection valve (12) for one cylinder of the engine, in which the high-pressure fuel pump (10) has a pump piston (18), which is driven by the engine in a reciprocating motion and defines a pump work chamber (22), with an electrically controlled valve (23), by which a communication of the pump work chamber (22) with a relief chamber (24) is controlled, and the fuel injection valve (12) has an injection valve member (28), by which at least one injection opening (32) is controlled and which is movable in an opening direction (29) by the pressure prevailing in a pressure chamber (40) communicating with the pump work chamber (22) counter to the force of a closing spring (44) disposed in a spring chamber (46), and the closing spring (44) is braced on one end at least indirectly on the injection valve member (28) and on the other at least indirectly on a displaceably deflection piston (50), which on its side remote from the closing spring (44) defines a prechamber (85), communicating with the pump work chamber (22), and the deflection piston (50), beginning at an outset position at low pressure in the pump work chamber (22), is displaceable counter to the force of the closing spring (44) into a storage chamber (55), and the prechamber (85) communicates with the pump work chamber (22) via a first throttle restriction (84), the improvement wherein the pressure chamber (40) of the fuel injection valve (12) communicates directly with the pump work chamber (22), circumventing the prechamber (85), and wherein at least one second throttle restriction (93) is disposed in the communication (48) of the pressure chamber (40) and the pump work chamber (22).

2. The fuel injection system of claim 1, wherein the first throttle restriction (84) between the prechamber (85) and the pump work chamber (22) is embodied as a throttle bore in a shim (83) between a pump body (14), in which the pump piston (18) is guided, and a housing part (81), in which the deflection piston (50) is guided.

3. The fuel injection system of claim 1, wherein the at least one second throttle restriction (93) is disposed in a housing part (86; 89) of the fuel injection valve (12).

4. The fuel injection system of claim 2, wherein the at least one second throttle restriction (93) is disposed in a housing parts (86; 89) of the fuel injection valve (12).

5. The fuel injection system of claim 1, wherein the at least one second throttle restriction (93) is disposed in a shim (90) between housing parts (86, 89) of the fuel injection valve (12).

6. The fuel injection system of claim 2, wherein the at least one second throttle restriction (93) is disposed in a shim (90) between housing parts (86, 89) of the fuel injection valve (12).

* * * * *